US009987192B2

(12) United States Patent
Wu

(10) Patent No.: US 9,987,192 B2
(45) Date of Patent: Jun. 5, 2018

(54) MASSAGING DEVICES

(71) Applicant: Wei Wu, Huzhou (CN)

(72) Inventor: Wei Wu, Huzhou (CN)

(73) Assignee: LOVER HEALTH SCIENCE AND TECHNOLOGY CO., LTD., Huzhou (CN)

( * ) Notice: Subject to any disclaimer, the term of this patent is extended or adjusted under 35 U.S.C. 154(b) by 338 days.

(21) Appl. No.: 14/603,786

(22) Filed: Jan. 23, 2015

(65) Prior Publication Data

US 2015/0196453 A1 Jul. 16, 2015

Related U.S. Application Data

(63) Continuation-in-part of application No. PCT/CN2012/088151, filed on Dec. 31, 2012.

(30) Foreign Application Priority Data

Jul. 24, 2012 (CN) ..... 2012 1 0257126

(51) Int. Cl.
*A61H 19/00* (2006.01)
*A61H 23/02* (2006.01)

(52) U.S. Cl.
CPC ..... *A61H 23/0263* (2013.01); *A61H 19/44* (2013.01); *A61H 2201/0153* (2013.01); *A61H 2201/1253* (2013.01); *A61H 2201/5025* (2013.01)

(58) Field of Classification Search
CPC .... A61H 23/02; A61H 23/0263; A61H 19/30; A61H 19/34; A61H 19/44; A61H 19/50; A61H 2201/0157; A61H 2201/1207; A61H 2201/1215; A61H 2201/5007; A61H 2201/5043; A61H 2201/5046; A61H 2201/0188; A61H 2201/5015; A61H 2201/5097; A61H 2201/5092; A61H 2201/5064; A61H 2201/5035; A61H 2201/5012; A61H 2205/087
USPC ..... 200/11 TW; 600/38–41; 601/46
See application file for complete search history.

(56) References Cited

U.S. PATENT DOCUMENTS 5,912,661 A * 6/1999 Siddiqui ..... G01D 5/2451 345/157
6,188,389 B1 * 2/2001 Yen ..... G06F 3/03543 345/163
2005/0033112 A1 * 2/2005 Bruton ..... A61H 19/44 600/38
2006/0069330 A1 * 3/2006 Nan ..... A61H 19/34 601/72

(Continued)

*Primary Examiner* — Justine Yu
*Assistant Examiner* — Timothy Stanis
(74) *Attorney, Agent, or Firm* — Anova Law Group, PLLC

(57) ABSTRACT

A massaging device is provided. The massaging device includes a shell having first end and a second end, the first end being a massaging head, a size and a shape of the shell configured to massage a body part of a user. The massaging device also includes an opening disposed close to the second end. The massaging device further includes a housing to house a vibrating motor, the housing configured to be inserted into the shell through the opening. The massaging device also includes a rolling member disposed at the opening, and the rolling member is configured to control the vibration of the vibrating motor when being operated by a user.

20 Claims, 6 Drawing Sheets

(56) References Cited

U.S. PATENT DOCUMENTS

| | | | | |
|---|---|---|---|---|
| 2006/0187206 | A1* | 8/2006 | Jing | G06F 3/03543 345/163 |
| 2006/0287616 | A1* | 12/2006 | Nan | A45D 34/041 601/17 |
| 2007/0188451 | A1* | 8/2007 | Sun | A61H 23/0263 345/163 |
| 2008/0306417 | A1* | 12/2008 | Imboden | A61H 19/00 601/134 |
| 2012/0136289 | A1* | 5/2012 | McGann | A61H 23/0263 601/78 |
| 2012/0215141 | A1* | 8/2012 | Peddicord | A61H 9/0078 601/46 |
| 2013/0060081 | A1* | 3/2013 | Carter | A61H 19/44 600/38 |
| 2014/0228629 | A1* | 8/2014 | Baetica | A61H 19/34 600/38 |
| 2015/0359704 | A1* | 12/2015 | Imboden | A61H 19/00 601/72 |

* cited by examiner

MASSAGING DEVICES

CROSS REFERENCE TO RELATED APPLICATIONS

This application is a continuation-in-part of International Application Serial No. PCT/CN2012/088151 filed on Dec. 31, 2012, the entire contents of which are hereby incorporated by reference, which claims the priority benefit of Chinese Patent Application No. 201210257126.8, filed on Jul. 24, 2012, the entire contents of which are hereby incorporated by reference.

FIELD OF INVENTION

The present invention relates to the field of adult-themed toys and, more particularly, to a massaging device with user control.

BACKGROUND

The massaging devices, such as massaging devices used for sexual stimulation, on the current market usually include a shell, which is usually made of soft material, such as rubber, a potentiometer and a rotary potentiometer switch. The potentiometer is usually disposed at an end of the shell. The switch may switch a vibrating motor on or off and may adjust the angular velocity of the motor. Such massaging devices may have certain disadvantages. For example, a user may mistakenly switch off the massaging device when the user rotates the switch, which may affect the mood of the user negatively and reduce the effect of massaging. Further, the adjustable levels are limited. A rotary switch can only be adjusted between 0° and 360°, which limits available adjustable levels, and thus it may be difficult to adjust the strength of vibration, which is determined by the vibrating speed.

The disclosed massaging device is directed at solving one or more problems set forth above and other problems.

BRIEF SUMMARY OF THE DISCLOSURE

One aspect of the present disclosure provides a massaging device. The massaging device includes a shell having first end and a second end, the first end being a massaging head, a size and a shape of the shell configured to massage a body part of a user. The massaging device also includes an opening disposed close to the second end. The massaging device further includes a housing to house a vibrating motor, the housing configured to be inserted into the shell through the opening. The massaging device also includes a rolling member disposed at the opening, and the rolling member is configured to control the vibration of the vibrating motor when being operated by a user.

Another aspect of the present disclosure provides a method of using a massaging device. The massaging device includes a shell having a first end and a second end, the first end being a massaging head, a size and a shape of the shell configured to massage a body part of a user; an opening close to the second end; a housing to house a vibrating motor, the housing configured to be inserted into the shell through the opening; and a rolling member disposed at the opening, the rolling member configured to control the vibration of the vibrating motor when being operated by a user. The method includes contacting the first end to a body part to be massaged and vibrating the first end by controlling the rolling member to massage the body part.

Other aspects of the present disclosure can be understood by those skilled in the art in light of the description, the claims, and the drawings of the present disclosure.

DETAILED DESCRIPTION

Reference will now be made in detail to exemplary embodiments of the invention, which are illustrated in the accompanying drawings. Wherever possible, the same reference numbers will be used throughout the drawings to refer to the same or like parts.

Figure 1:
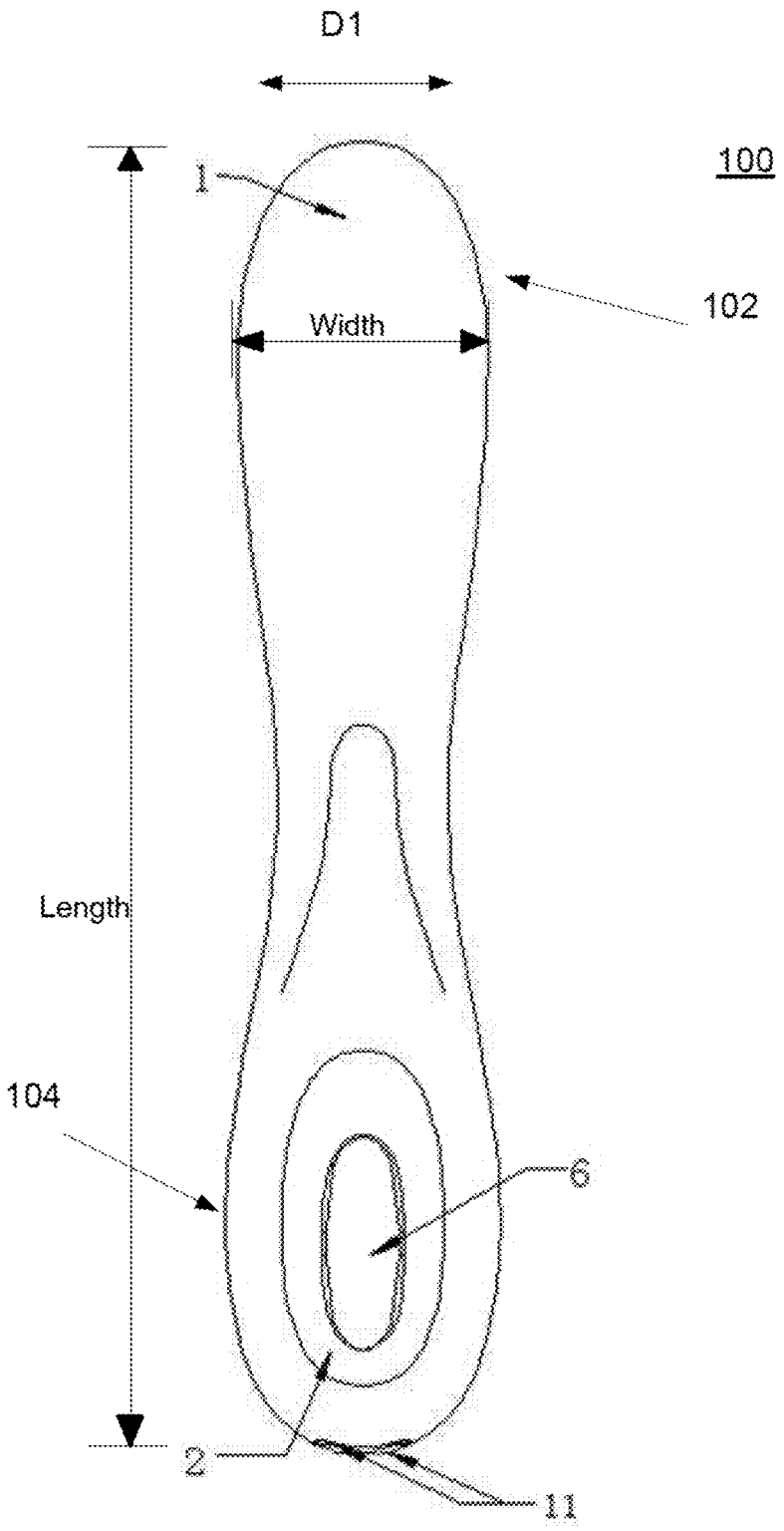
FIG. 1 illustrates an exemplary massaging device consistent with the disclosed embodiments.

FIG. 1 illustrates an exemplary massaging device 100 consistent with the disclosed embodiments. As shown in FIG. 1, the massaging device 100 may include a shell 1, a rolling member 6, a first supporting member 2 for the rolling member 6, and a power supply member 11. The massaging device 100 may also include a first end 102 and a second end 104.

The shell 1 may be made of any appropriate material. In certain embodiments, the shell 1 may be made of a soft material, such as rubber, silicone, or elastomer. The shell 1 has a width W and a length L. The width W may be uniform along the length of the shell 1. The width W may also not be uniform along the length L of the shell 1. In certain embodiments, the width W may be smaller at the middle of the length L. The width W and the length L may be adjusted and determined empirically.

The first end 102 may be a massaging head and may have any appropriate shape. In certain embodiments, the device 100 may be used for sexual stimulation and the first end 102 may be shaped for sexual stimulation. For example, the first end 102 may be in the shape of a male sexual organ, or a shape of a teardrop, an ellipse, or a ball. The first end 102 may also be in any other appropriate shape. The first end 102 may vibrate/move along the first dimension D1. The vibration strength, frequency, and the range along the D1 dimension may be adjusted.

The rolling member 6 may be configured to rotate along an axis. In certain embodiments, the rolling member 6 may have a structure similar to a scroll wheel in a computer mouse. The rolling member 6 may have any appropriate structure. The first supporting member 2 may support the rolling member 6 and provide a space for the rolling member to rotate about an axis. The rolling member 6 and the first supporting member 2 may be located at the second end 104. The rolling member 6 and the first supporting member 2 may also be located at any appropriated position on the device 100. The power supply member 11 may provide power to the device 100. In certain embodiments, the power supply member 11 may be a charging point for charging a rechargeable battery in the device 100. In certain embodiments, the power supply member 11 may be a magnetic charging point.

Figure 2:
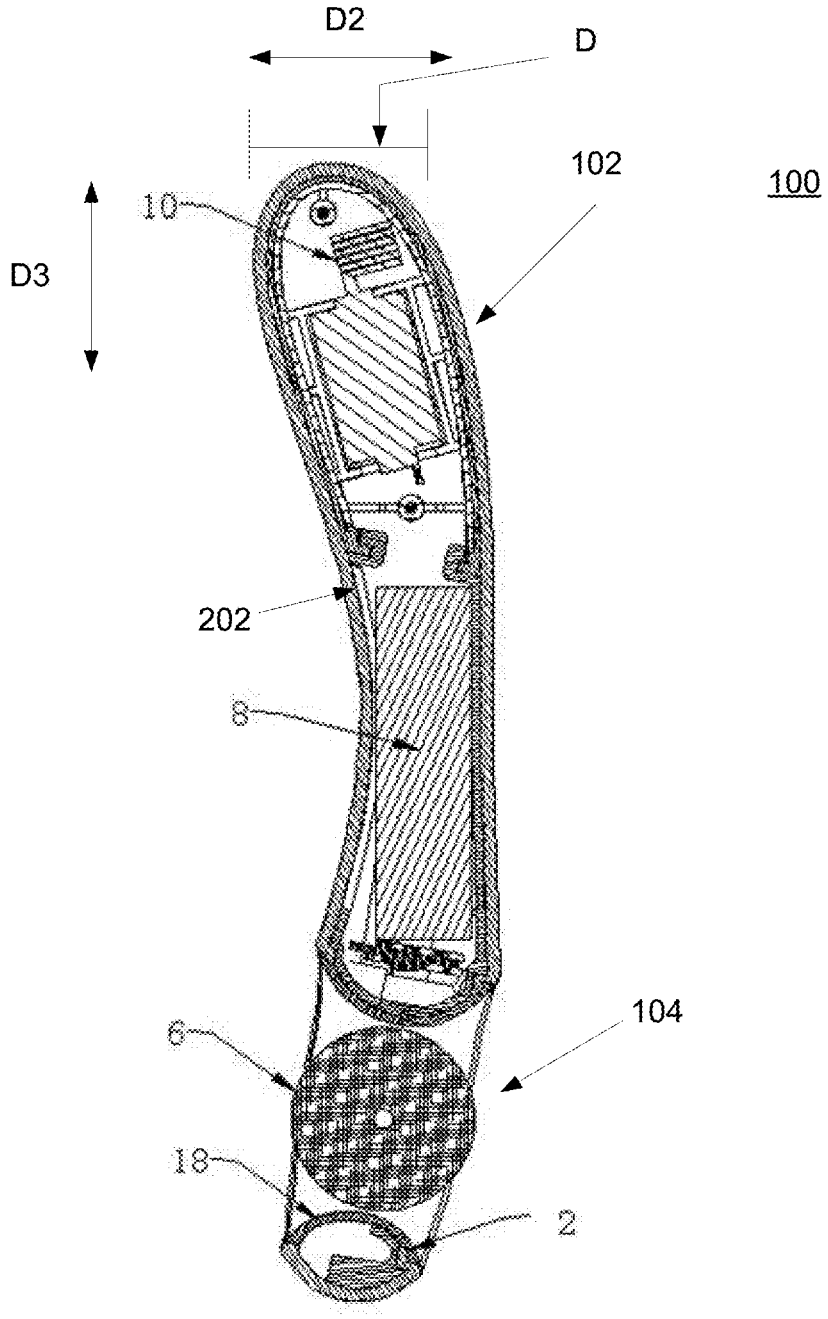
FIG. 2 illustrates a side cross section view of the exemplary massaging device consistent with the disclosed embodiments.

FIG. 2 illustrates a side cross-section view of the exemplary massaging device 100 consistent with the disclosed embodiments. As shown in FIG. 2, the device 100 may include a housing 202, a vibrating motor 10, a power source 8, the rolling member 6, the first supporting member 2 and a second supporting member 18 for the rolling member 6. The device 100 may have a depth dimension D. The depth dimension D may be adjusted and determined empirically. The depth dimension D may be uniform along the length L of the device 100. The depth dimension D may also not be uniform along the length of the device 100. In certain embodiments, the depth dimension D may be smaller at the middle point of the length L.

The width dimension W, the depth dimension D, and the length dimension L may be configured to accommodate a user's demand. For example, the width dimension W and the depth dimension D may be configured so a user may place the device 100 in a body part, for example, vagina, for massaging. The length L may be configured to allow a user to operate on the rolling member 6 while the first end 102 is in certain position, for example, the area around the G spot in a vagina.

The housing 202 may be configured to house certain components of the device 100, such as the motor 10, the power source 8, and other components. The housing 202 may be made of any appropriate materials. In certain embodiments, the housing 202 may be made of a material with certain rigidity and the component within the housing 202 may be protected.

The vibrating motor 10 may vibrate to cause the first end 102 to vibrate to give the user a massage. As shown in FIG. 1, the first end 102 may move/vibrate along a first dimension D1. Returning to FIG. 2, the first end 102 may move/vibrate along a second dimension D2. The frequency, strength and range of the vibration along the second dimension D2 may be adjusted. The first end 102 may also move/vibrate along a third dimension D3. The frequency, strength and range of the vibration along the third direction D3 may be adjusted. The vibration along the D1, D2 and D3 dimension may be in any appropriate combination. For example, the vibration along the D1 dimension may or may not have the same strength, frequency and/or range of the vibration along the D2 and/or D3 dimension. The first end 102 may also vibrate along one dimension only.

In certain embodiment, the motor 10 may be located at the first end 102. The materials for making the shell 1 may be of such a property to allow the vibrations of the first end 102 as driven by the motor 10. For example, the shell 1 may be flexible enough to permit the first end 102 move along the second dimension D2 and the third dimension D3. When vibrating, the first end 102 may move/vibrate longitudinally, transversely, vertically, and/or circularly along any directions and/or dimensions. The motor 10 may also be located at any appropriate position and cause the first end 102 to vibrate/move by any appropriate means.

The power source 8 may provide power to the vibrating motor 10 and other components of the device 100. The power source 8 may be any appropriate device that may provide electrical power to the components of the device 100. For example, the power source 8 may be battery or a rechargeable battery.

The second supporting member 18 may support the rolling member 6 and provide a space for the rolling member to rotate along an axis. The rolling member 6, the first supporting member 2, and the second supporting member 18 may be located at the second end 104. The rolling member 6, the first supporting member 2, and the second supporting member 18 may also be located at any appropriated position on the device 100.

Figure 3:
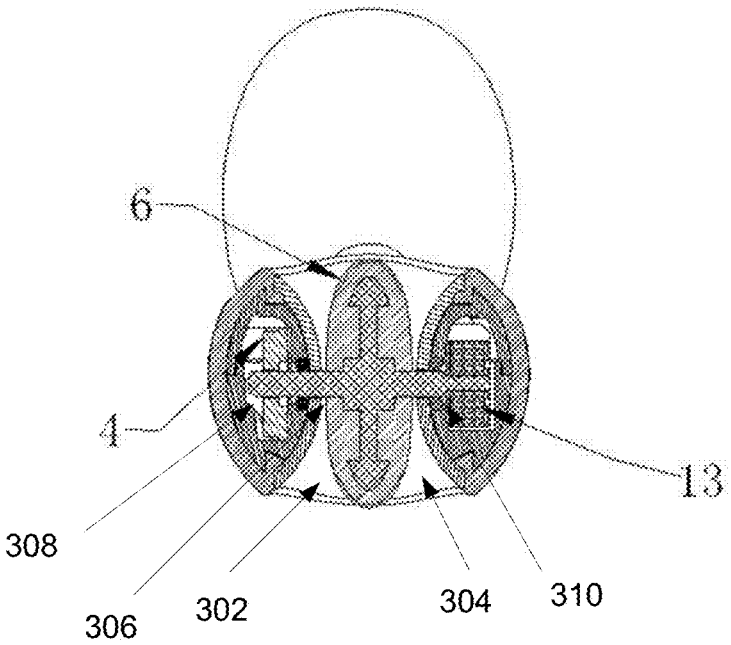
FIG. 3 illustrates a cross section view of an assembly of an exemplary rolling member.

FIG. 3 illustrates a cross section view of an assembly of an exemplary rolling member 6. As shown in FIG. 3, the rolling member 6 may be assembled together with an electric circuit board 4 and a rolling member coder 13. The rolling member 6 may have a first side 302 and a second side 304. The rolling member 6 may be electrically connected to the circuit board 4 and the coder 13. The rolling member 6, the circuit board 4, and the coder 13 may be assembled and connected by any appropriate manner. In certain embodiments, the circuit board 4 and the coder 13 may be located facing the first side 302 and the second side 304, respectively, and electrically connected to the rolling member 6 through a rotating axis 306. The rotating axis 306 may include a first end 308 and a second end 310. The first end 308 may connect electrically to the circuit board 4 and the second end 310 may connect electrically to the coder 13.

In certain embodiments, when the rolling member 6 is pressed, the end 308 of the axis 306 may press a switch mechanism on the electric circuit board 4 to switch on/off the vibration motor 10 or to change the vibrating pattern. The circuit board 4 may be configured to respond to different pattern of pressing on rolling member 6. For example, in certain embodiments, the switch mechanism on circuit board 4 may have three options: a resting option, a vibrating option, and an intermittent vibrating option. The vibrating motor 10 is turned on when user presses the rolling member 6 once to choose the vibrating option. The vibrating motor 10 may change to intermittent vibration when a user presses the rolling member 6 twice to choose the intermittent vibrating option. The vibrating motor 10 may be switched off when a user presses rolling member 6 for longer than a pre-determined time period, for example, three seconds to return to the resting option. The circuit board 4 may be configured to have different options and respond to any appropriate pressing pattern.

In certain embodiments, an aspect of the vibration of the vibrating motor 10 may be regulated by a type of rotation information of the rolling member 6. The rotation of/or the rolling member 6 is coupled to the coder 13 and the circuit board 4. The rotation information of the rolling member 6, such as a position, a speed, and/or a direction of the rotation of the rolling member 6 may be transferred to the coder 13 via the end 310. That is, the end 310 may have corresponding position, speed, and/or direction of the rotation information of the rolling member 6. For example, when the rolling member 6 rotates at an increasing speed, the end 310 rotates at an increasing speed accordingly. Similarly, the rotation information may be transferred to the circuit board 4 via the end 308.

In certain embodiments, the coder 13 may have a sensing or coupling mechanism to detect the rotation information of the end 310. The coder 13 may respond to the rotation information of the end 310 and generate a signal to the vibrating motor 10. For example, when the coder 13 detects an increasing rotation speed of the end 310, it may generate a signal to vibrating motor 10 to increase the vibrating strength. In certain embodiments, the coder 13 may generate a digital signal for the vibrating motor 10. Similarly, in certain embodiments, the coder 13 may couple the direction of the rotation to a direction of the vibration of the vibrating motor 10. In certain embodiments, the coder 13 may couple the position of rolling member 6 (the angle relative to a base line) to a range of the vibration of the vibrating motor 10.

The vibrating direction, strength, frequency, range and/or other aspect may be coupled to any appropriate rotation information of the rolling member 6.

Other mechanisms may also be used. For example, in certain embodiments, the rotation information of the rolling member 6 may be transformed into an electrical signal the rolling member 6 and the electrical signal is transferred to the coder 13. Thus, the end 310 may not rotate with the rolling member 6. Rather, the axis 306 conducts the electrical signal to coder 13. For example, a higher rotation speed of the rolling member 6 may be transformed into a greater electrical current. The coder 13, corresponding to the greater current, may generate a signal for the vibrating motor 10 to vibrate with higher frequency. Other types of rotation information of the rolling member 6 may be transformed into other electrical signal. For example, the position of the rolling member 6 (angle relative to a base line) may be transformed into voltage signal. The coder 13 may respond to different type of electrical signal to general signal for the vibrating motor 10 to adjust the vibration. The types of rotation information of the rolling member 6, such as direction, speed, position, and/or any other information may be transformed into any appropriate electrical signal and the coder 13 may respond accordingly.

The rotation information of the rolling member 6 may be transferred to the coder 13 through any appropriate mechanism in addition to the electrical signal mechanism and coupling mechanism through the end 310.

The rotation information of the rolling member 6 may be similarly used by the circuit board 4 to control the vibration of the vibrating motor 10. For example, in certain embodiments, the vibration direction of the vibrating motor 10 may be controlled by the circuit board 4 rather than the coder 13. The circuit board 4 and the coder 13, working alone or in any appropriate combination, may receive the rotation information of the rolling member 6 through the ends 308 and 310, respectively, and may generate signals for the vibrating motor 10 to adjust the vibration.

Figure 4:
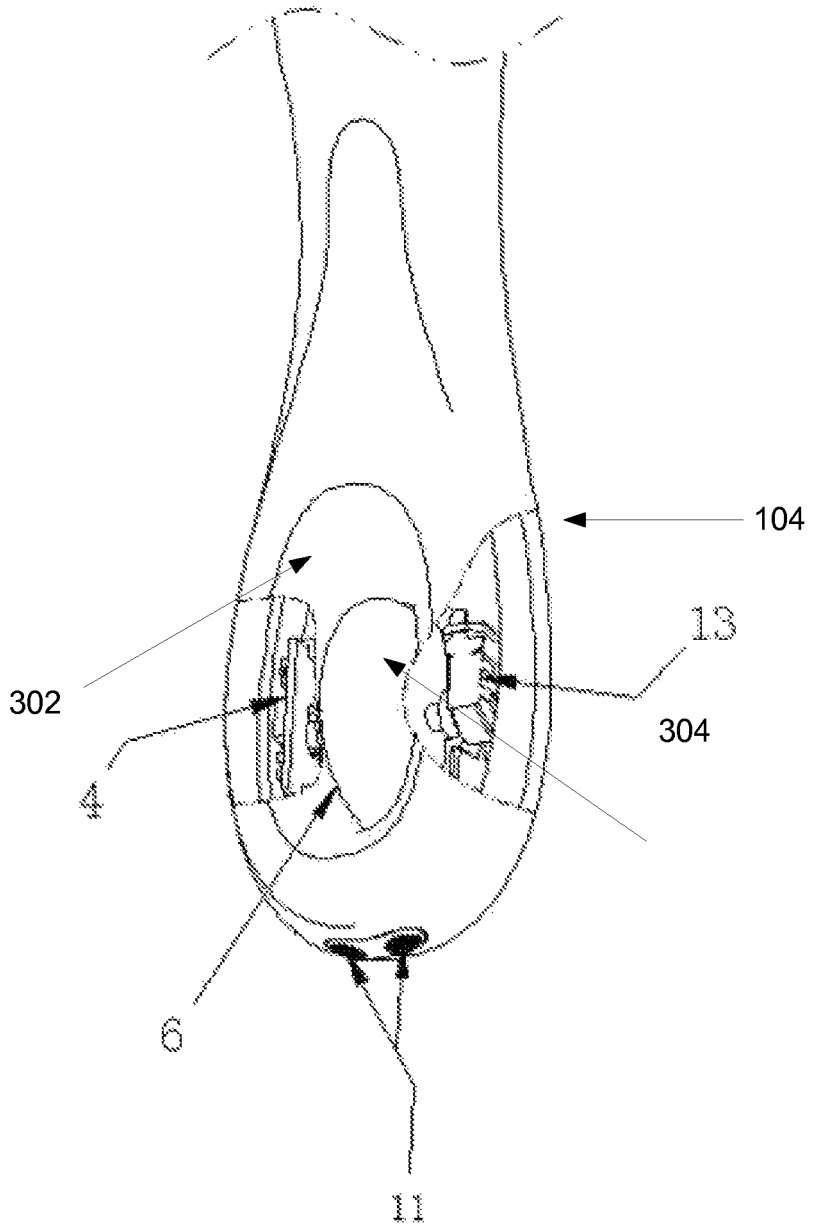
FIG. 4 illustrates a three-dimensional view of an assembly of an exemplary rolling member.

FIG. 4 illustrates a three-dimensional view of an assembly of an exemplary rolling member 6. As shown in FIG. 4, the rolling member may be located at the second end 104. The electric circuit board 4 may be located on the first side 302 and the coder 13 may be located on the second side 304. Other configurations may also be used.

Figure 5:
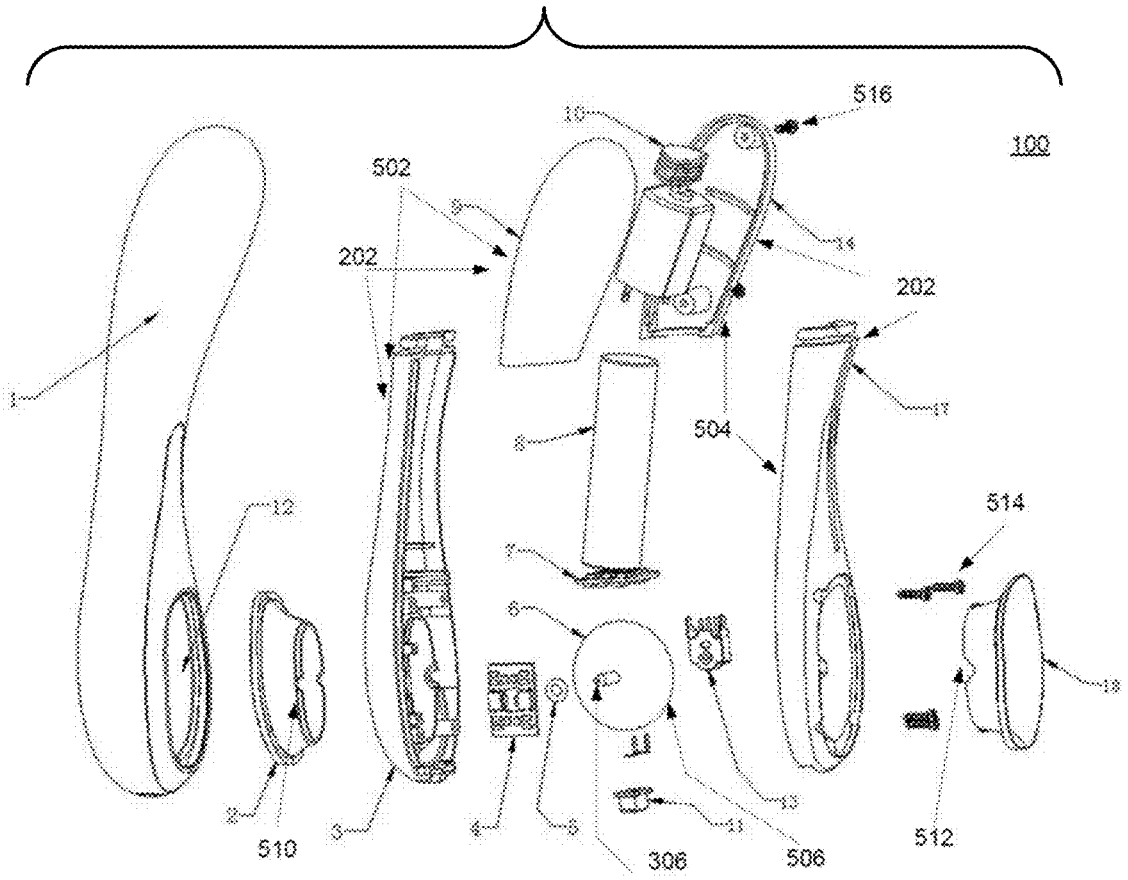
FIG. 5 illustrates an exploded view of an exemplary massaging device.

FIG. 5 illustrates an exploded view of an exemplary device 100. As shown in FIG. 5, the device 100 may include an opening 12. The opening 12 may be configured to allow the housing 202 to be inserted into the shell 1. The opening 12 may also be configured to expose the rolling member 6 as shown in FIG. 1.

The housing 202 may be formed by attaching a first housing member 502 and a second housing member 504 together. The first housing member 502 and the second housing member 504 may be attached together by any appropriate means. In certain embodiments, the first housing member 502 and the second housing member 504 may be attached by a snapping mechanism. In certain embodiments, the first housing member 502 and the second housing member 504 may be attached together by screws 514 and/or 516. The housing members 502 and 504 may be permanently attached together. The housing members 502 and 504 may also be removably attached together. In certain embodiments, the opening 12 is disposed on the second housing member 504.

The first housing member 502 may be formed by attaching a third housing member 3 and a fourth housing member 9 together. The third housing member 3 and the fourth housing member 9 may be attached together by any appropriate means. In certain embodiments, the third housing member 3 and the fourth housing member 9 may be attached by a snapping mechanism. The housing members 3 and 9 may be permanently attached together. The housing members 3 and 9 may also be removably attached together. In certain embodiments, the housing member 3 may be may be disposed close to the first end 102 and the housing member 9 may be disposed close to the second end 104.

The second housing member 504 may be formed by attaching a fifth housing member 14 and a sixth housing member 17 together. The fifth housing member 14 and the sixth housing member 17 may be attached together by any appropriate means. In certain embodiments, the fifth housing member 14 and the sixth housing member 17 may be attached by a snapping mechanism. The housing members 14 and 17 may be permanently attached together. The housing members 14 and 17 may also be removably attached together. In certain embodiments, the housing member 14 may be disposed close to the first end 102 and the housing member 17 may be disposed close to the second end 104.

The rolling member 6 may include a rolling wheel 506 and the rotating axis 306. As shown in FIG. 3, the rotating axis 306 may include a first end 308 and a second end 310. Returning to FIG. 5, the first supporting member 2 may include an opening 510. A second supporting member 18 may include an opening 512. The first supporting member 2 and the second supporting member 18 may be attached together and the openings 510 and 512 may form a supporting opening to allow the first end 308 and the second end 310 to be disposed therein. The first supporting member 2 and the second supporting member 18 may also be configured to provide a space for the rolling wheel 506 to be rolled therein when the first supporting member 2 and the second supporting member 18 are attached together.

A washer 5 may be disposed between the axis 306 and the supporting opening formed by the openings 510 and 512. The washer 5 may be made of any appropriate materials. In certain embodiments, the washer 5 may be made of an elastic material, such as a rubber or an elastomer. Thus, when the rolling member 6 is pressed by a user, the rolling member 6 is pressed down and the washer 5 is deformed to allow the axis 306 to transfer the pressing to the circuit board 4. When the user releases the pressing force, the washer 5 may return to its non-deforming status and lift the rotating axis 306 from the circuit board 4. The device 100 may further include a printed circuit board assembly (PCBA) 7. The PCBA 7 may be configured to generate vibrating pattern for the first end 102.

The circuit board 4, the coder 13, and the PCBA 7, working alone or in any appropriate combination, may generate vibrating pattern for the first end 102. Referring to FIGS. 1 and 2, the first end may move/vibrate along the first dimension D1, the second dimension D2, and the third dimension D3. Any two dimensions of the first dimension D1, the second dimension D2, and the third dimension D3 may form an angle between 0° and 90°. The vibrating frequency, strength, range and/or another aspect along the dimensions D1, D2, and D3 may be in any appropriate combination.

Figure 6:
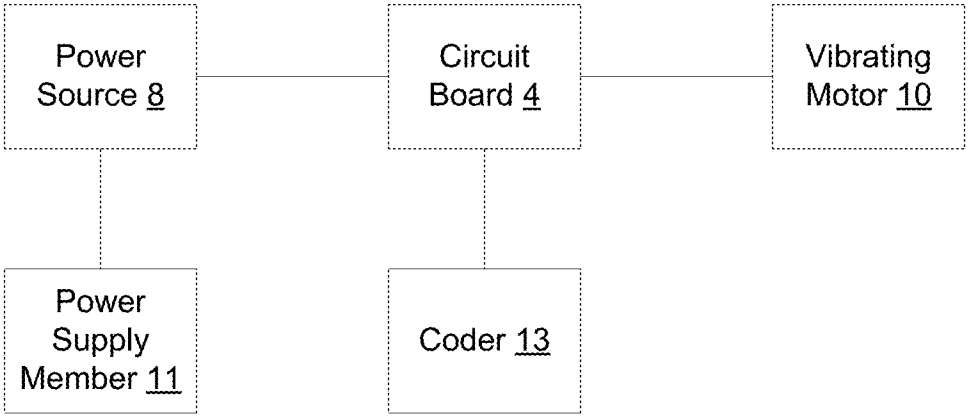
FIG. 6 illustrates an exemplary electrical circuit diagram of an exemplary massaging device.

FIG. 6 illustrates an exemplary electrical circuit diagram of an exemplary device 100. As shown in FIG. 6, the power supply member 11, the power source 8, the circuit board 4, the coder 13, and the vibrating motor 10 may be electrically connected. Thus, the power source 8 may provide electricity to the components of the device 100, such as the circuit board 4, the coder 13, and the vibrating motor 10. The circuit board 4 and the coder 13 may provide instruction to the vibrating motor 10. Other components of the device 100 may also be connected to the electricity circuit. The electrical circuit of the device 100 may be arranged in any appropriate manner.

A user may use the device 100 to massage a body part. The user may contact the first end 102 to a body part to be massaged. The user then may vibrate the first end 102 by controlling the rolling member 106 to massage the body part.

A device consistent with the disclosed embodiments may offer certain advantages. For example, a switch off signal may be configured to a press on the rolling member 6 for a pre-determined time period. Thus, it is unusual for a user to turn off the vibration inadvertently. The device may be turned on/off and a vibrating pattern may be adjusted by pressing the rolling member 6. The rolling member 6 may be rotated to adjust an aspect of the vibration in fine scale. For example, rotating the rolling member 6 may increase the vibrating strength. The scope of the adjustment may also be increased because the rolling member 6 may not limited to rotate only 360°. Rather, in theory, the scope of the adjustment of a vibrating aspect based on the rotation of the rolling member 6 may be unlimited. The rolling member 6 may also rotate on two directions, further increasing the adjustment scope.

Further, the housing members may be removably attached by snapping mechanism. Such attach mechanism may enable a user to change and/or clean a component of the device 100.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications. For example, the size, shape, and manufacturing material may be changed for a massaging device according to the disclosed embodiments to be used for massaging different body parts.

What is claimed is:

1. A massaging device, comprising:

a soft shell having a first end and a second end, the first end being a massaging head, a size and a shape of the shell configured to massage a body part of a user;

an opening disposed close to the second end, the opening having an axis substantially parallel to a cross section of the second end of the soft shell, and the opening having at least two sides including a front side and a back side;

a vibrating motor configured to cause vibration of the first end;

a housing to house the vibrating motor, the housing being covered by the soft shell;

a rolling member disposed at the opening, the rolling member being configured to control vibration of the vibrating motor when the rolling member is operated by a user; and a supporting member mounted on the housing, the supporting member having a compatible shape with the opening of the soft shell and being configured to support the rolling member and provide a space for the rolling member to be rolled and pressed; wherein:

the rolling member further includes: a rotating axis housed by the supporting member, and a rolling wheel that rotates about the rotating axis; and a rim of the rolling wheel protrudes from surfaces of the supporting member at the front side of the opening and at the back side of the opening, for making the rolling member accessible and rotatable by the user at both sides of the massaging device.

2. The massaging device of claim 1, wherein the housing further includes:

a first housing member; and a second housing member, wherein the first housing member is removably attached to the second housing member to form the housing.

3. The massaging device of claim 2, wherein:

the first housing member is formed by removably attaching a third housing member and a fourth housing member; and the second housing member is formed by removably attaching a fifth housing member and a sixth housing member.

4. The massaging device of claim 1, wherein the supporting member further includes:

a first supporting member disposed at the front side of the opening of the soft shell with a first opening; and a second supporting member disposed at the back side of the opening of the soft shell with a second opening; wherein:

a supporting opening is formed by the first opening and the second opening when the first supporting member is attached to the second supporting member; and the rotating axis is disposed on the supporting opening.

5. The massaging device of claim 4, further including:

an electric circuit board disposed at a first side of the rolling member; and a rolling member coder disposed at a second side of the rolling member, wherein:

the electric circuit board and the rolling member coder are electrically connected to the rolling member through the rotating axis; and the electric circuit board and the rolling member coder are configured to detect an operation pattern of the rolling wheel, and generate a corresponding control signal for the vibrating motor based on the operation pattern of the rolling wheel.

6. The massaging device of claim 5, further including:

a washer disposed between the supporting opening and the rotating axis, wherein the washer is configured to be deformed when the rolling member is pressed to allow the rotating axis to press on the electric circuit board and to return to non-deformed position to lift the rotating axis from the electric circuit board.

7. The massaging device of claim 5, wherein:

the electric circuit board controls the switch-on and switch-off of a vibrating pattern of the vibrating motor; and the electric circuit board responds to a pressing pattern on the rolling member to create the corresponding control signal to control the vibrating motor.

8. The massaging device of claim 1, wherein the vibration of the first end is controlled by pressing signal received by the rolling member, and a pattern of the vibration is determined based on at least one of: a number of times that the rolling member is pressed, or a time duration that the rolling member is pressed, the pattern of vibration including at least one of: a vibrating direction, a vibrating strength, a vibrating frequency, or a vibrating range.

9. The massaging device of claim 1, wherein the vibration of the first end is controlled by rotation information of the rolling member, the rotation information including at least one of a rotation speed, a rotated position, or a direction of rotation, and based on the rotation information, at least one of: a vibrating direction, a vibrating strength, a vibrating frequency, or a vibrating range of the vibration is adjusted.

10. The massaging device of claim 1, further including: a power source.

11. The massaging device of claim 1, further including: a power supply member.

12. A method of using a massaging device, the massaging device including a soft shell having a first end and a second end, the first end being a massaging head, a size and a shape of the shell configured to massage a body part of a user; an opening close to the second end; a housing to house a vibrating motor, the housing being covered by the soft shell; and a rolling member disposed at the opening, the rolling member being configured to control vibration of the vibrating motor when the rolling member is operated by a user, the method comprising:

contacting the first end to a body part to be massaged;

receiving a control signal from the rolling member; and based on the control signal, vibrating, by the vibrating motor, the first end to massage the body part, wherein:

the opening of the soft shell has an axis substantially parallel to a cross section of the second end of the soft shell, and has at least two sides including a front side and a back side;

the massaging device further includes a supporting member mounted on the housing, the supporting member having a compatible shape with the opening of the soft shell and being configured to support the rolling member and provide a space for the rolling member to be rolled and pressed;

a rim of the rolling wheel protrudes from surfaces of the supporting member at the front side of the opening and at the back side of the opening, for making the rolling member accessible and rotatable by the user at both sides of the massaging device; and the receiving a control signal from the rolling member further includes: receiving the control signal generated by pressing or rotating the protruded rim of the rolling member at the surfaces.

13. The method of claim 12, wherein: the housing further includes:

a first housing member and a second housing member, wherein the first housing member is removably attached to the second housing member to form the housing.

14. The method of claim 13, wherein:

the first housing member is formed by removably attaching a third housing member and a fourth housing member; and the second housing member is formed by removably attaching a fifth housing member and a sixth housing member.

15. The method of claim 12, wherein: the supporting member further includes:

a first supporting member disposed at the front side of the opening of the soft shell with a first opening; and a second supporting member disposed at the back side of the opening of the soft shell with a second opening;

wherein:

a supporting opening is formed by the first opening and the second opening when the first supporting member is attached to the second supporting member; and the rotating axis is disposed on the supporting opening.

16. The method of claim 15, wherein: the massaging device further includes: an electric circuit board disposed at a first side of the rolling member; and a rolling member coder disposed at a second side of the rolling member, wherein:

the electric circuit board and the rolling member coder are electrically connected to the rolling member through the rotating axis; and the method further comprises:

detecting, by the electric circuit board and the rolling member coder, an operation pattern of the rolling wheel, and generating the control signal for the vibrating motor based on the operation pattern of the rolling wheel.

17. The method of claim 16, wherein: the massaging device includes: a washer disposed between the supporting opening and the rotating axis, wherein the washer is configured to be deformed when the rolling member is pressed to allow the rotating axis to press on the electric circuit board and to return to non-deformed position to lift the rotating axis from the electric circuit board.

18. The method of claim 16, further comprising:

controlling, by the electric circuit board, switch-on and switch-off of a vibrating pattern of the vibrating motor; and responding, by the electric circuit board, to a pressing pattern on the rolling member to create the control signal to control the vibrating motor.

19. The method of claim 12, further comprising:

controlling the vibration of the first end by a pressing signal received from the rolling member, including:

determining a pattern of the vibration based on at least one of: a number of times that the rolling member is pressed, or a time duration that the rolling member is pressed, the pattern of vibration including at least one of: a vibrating direction, a vibrating strength, a vibrating frequency, or a vibrating range.

20. The method of claim 12, further comprising:

controlling the vibration of the first end by rotation information of the rolling member, the rotation information including at least one of a rotation speed, a rotated position, or a direction of rotation, including:

based on the rotation information, adjusting at least one of: a vibrating direction, a vibrating strength, a vibrating frequency, or a vibrating range of the vibration.

* * * * *